US007117770B2

(12) United States Patent
Hsien

(10) Patent No.: US 7,117,770 B2
(45) Date of Patent: Oct. 10, 2006

(54) DUAL FUNCTION WRENCH

(76) Inventor: Chih-Ching Hsien, No. 367, Pei Yang Rd., Feng Yuan, Taichung (TW)

( * ) Notice: Subject to any disclaimer, the term of this patent is extended or adjusted under 35 U.S.C. 154(b) by 0 days.

(21) Appl. No.: 11/237,736

(22) Filed: Sep. 29, 2005

(65) Prior Publication Data

US 2006/0021478 A1 Feb. 2, 2006

Related U.S. Application Data

(63) Continuation-in-part of application No. 10/797,090, filed on Mar. 11, 2004.

(51) Int. Cl.
*B25B 13/00* (2006.01)

(52) U.S. Cl. ..... 81/186; 81/119

(58) Field of Classification Search ..... 81/119, 81/125.1, 186

See application file for complete search history.

(56) References Cited

U.S. PATENT DOCUMENTS

| | | | | | |
|---|---|---|---|---|---|
| 37,865 | A | * | 3/1863 | Griswold | 81/125.1 |
| 916,951 | A | * | 3/1909 | Jeffery | 81/119 |
| 1,088,786 | A | * | 3/1914 | Lukowski | 81/177.6 |
| 1,297,846 | A | * | 3/1919 | Herman | 81/125.1 |
| 2,716,367 | A | * | 8/1955 | Montgomery | 81/124.3 |
| 3,921,476 | A | * | 11/1975 | Evans | 81/119 |
| 6,158,309 | A | * | 12/2000 | Baker | 81/119 |

* cited by examiner

*Primary Examiner*—Hadi Shakeri

(57) ABSTRACT

A dual function wrench includes two function ends and the two different function ends are overlapped with each other. Each function end includes a clamping space and the two respective clamping spaces are in communicating with each other. The first function end includes two fixed jaws which have two respective flat clamping surfaces facing with each other. The second function end is a quick release function end so as to rotate an object without removing the second function end from the object.

1 Claim, 3 Drawing Sheets

DUAL FUNCTION WRENCH

FIELD OF THE INVENTION

This application is a Continuation-In-Part application of applicant's former patent application with application Ser. No. 10/797,090, filed on Mar. 11, 2004.

BACKGROUND OF THE INVENTION

U.S. Pat. No. 37,865 to Griswold, U.S. Pat. No. 916,951 to Jeffery, U.S. Pat. No. 1,088,786 to Lukowski and U.S. Pat. No. 1,297,846 to Herrman disclose an overlapped function end that includes at least two pairs of flat clamping surfaces in the function end so as to clamp objects of different sizes. The opening between two jaws is designed very close to the size of object to be clamped so that the object is rotated with the wrench. Nevertheless, the user has to remove the wrench from the object and re-clamp the object again to rotate the object if the space for rotation of the wrench is limited. This spends too much time on removing and re-clamping the wrench.

The present invention intends to provide a wrench that has a dual function driving head which includes two fixed jaws on one side and a quick release wrench head on the bottom side so that the users need not to change tools frequently.

SUMMARY OF THE INVENTION

The present invention relates to a dual function wrench which comprises a driving head and a shank connected to the driving head. The driving head includes a first function end and a second function end, wherein the first function end is overlapped to the second function end. Each of the first function end and the second function end has a clamping space and the two respective clamping spaces are in communication with each other. The first function end includes two flat clamping surfaces facing with each other. The second function end includes a first jaw and a second jaw. The first jaw has a first convex surface facing the second jaw, and the second jaw has a second convex surface facing the first convex surface. A protrusion extends from a distal end of an inside of the second jaw and toward the first jaw. The protrusion includes a concaved clamping area which is connected to an end of the second convex surface.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
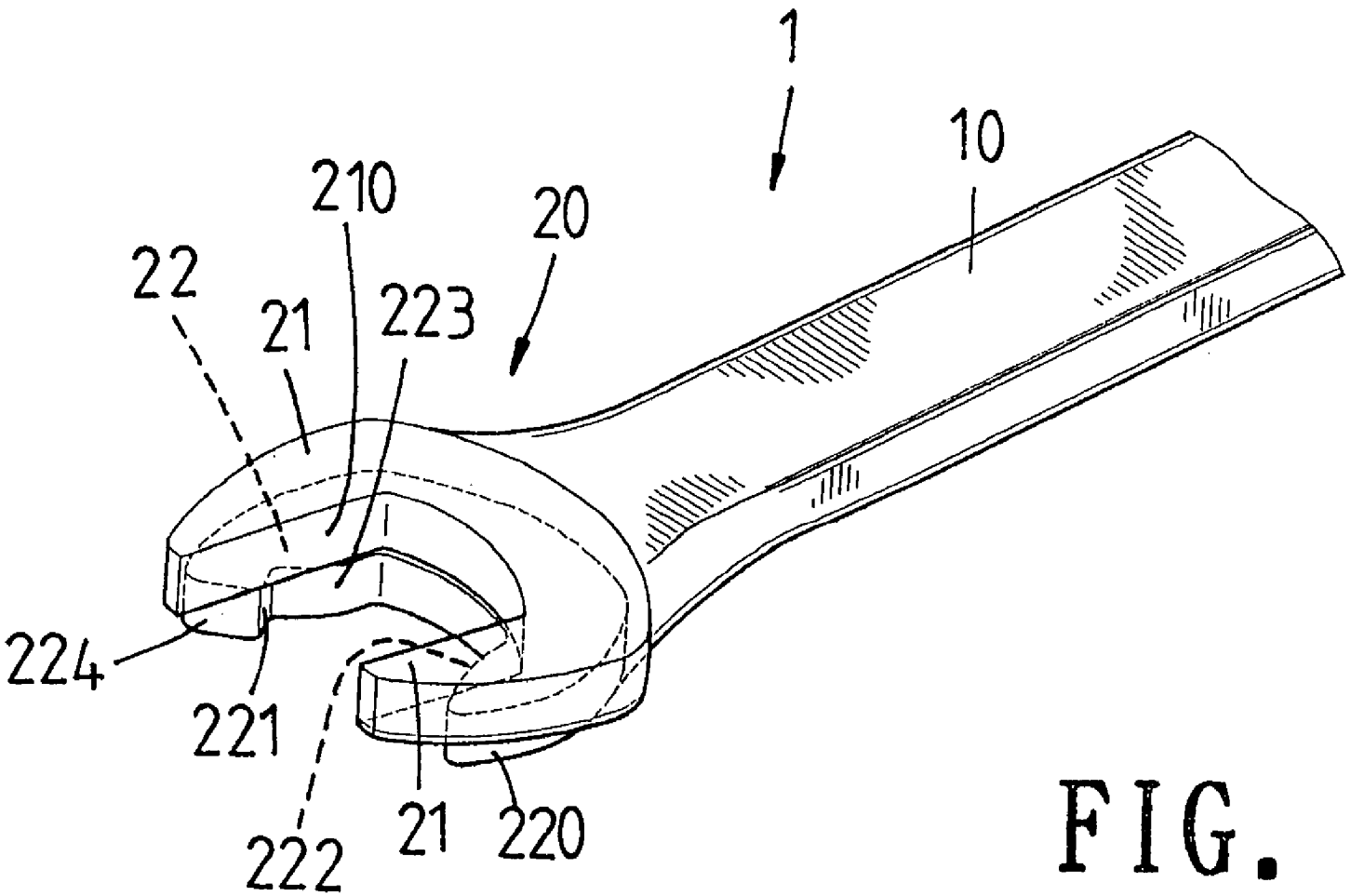
FIG. 1 is a perspective view to show a first embodiment of the dual function wrench of the present invention.
Figure 2:
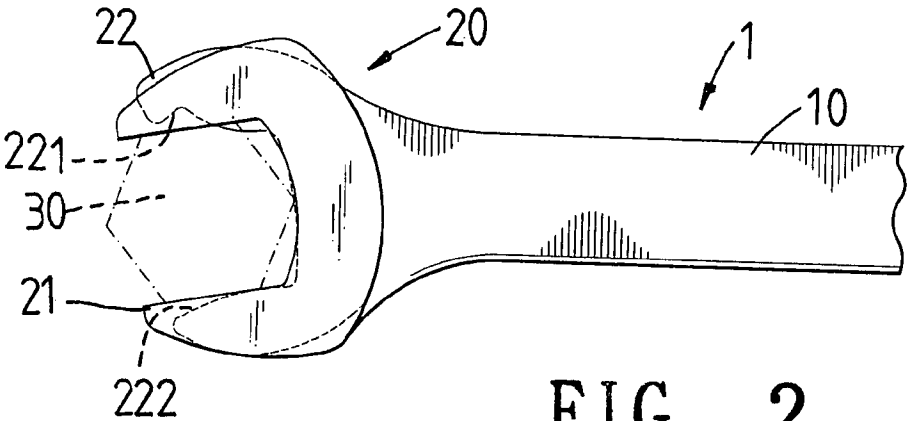
FIG. 2 shows a nut is clamped by one of the function ends of the dual function wrench of the present invention.

As shown in FIG. 1, the dual function wrench 1 of the present invention comprises a driving head 20 and a shank 10 connected to the driving head 20. The driving head 20 includes a first function end and a second function end. The first function end is overlapped to the second function end and the two respective clamping spaces are in communication with each other. The first function end includes two fixed jaws 21 and the two fixed jaws have two respective flat clamping surfaces 210 facing with each other. Therefore, two opposite sides of a bolt head 30 can be clamped by the two respective flat clamping surfaces 210 as shown in FIG. 2.

The second function end includes a first jaw 220 and a second jaw 22. The first jaw 220 has a first convex surface 222 facing the second jaw 22, and the second jaw 22 has a second convex surface 223 facing the first convex surface 222. A protrusion 224 extends from a distal end of an inside of the second jaw 22 and toward the first jaw 220. The protrusion 224 has a concaved clamping area 221 which is connected to an end of the second convex surface 223.

A first clamping space is defined between the two fixed jaws of the first function end and a second clamping space is defined between the first and second jaws. The first and second clamping spaces are the same size. The first clamping space and the second clamping space have a common access opening through which an object such as the bolt head 30 to be clamped by the wrench 1 is engaged with either the first clamping space or the second clamping space.

Figure 3:
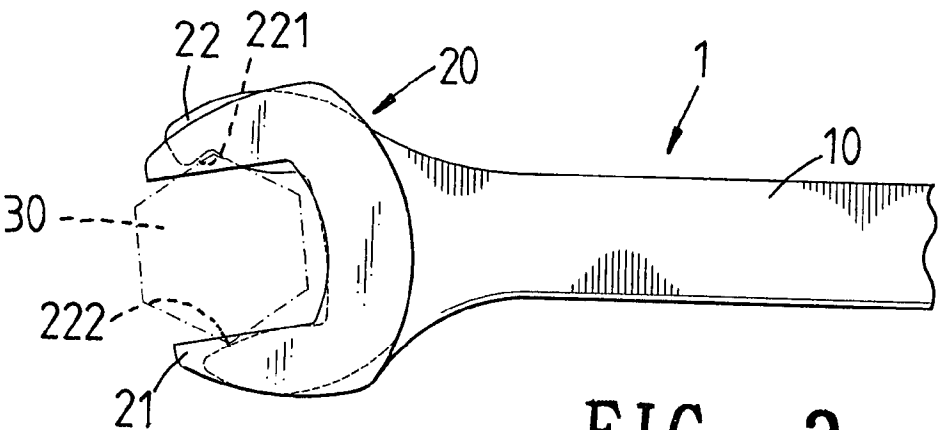
FIG. 3 shows a nut is clamped by the other one of the function ends of the dual function wrench of the present invention.

A corner of the bolt head 30 can be engaged with the concaved clamping area 221 as shown in FIG. 3 so that when the wrench 1 is rotated clockwise, the bolt head 30 is rotated with the rotation of the wrench 1, and when the wrench 1 is rotated counter clockwise, the concaved clamping area 221 is removed from corner and the wrench 1 is rotated to another angle and to let the concaved clamping area 221 to engage another corner of the bolt head 30. By this way, the second function end does not need to remove completely from the bolt head 30 and the wrench 1 can rotate the bolt head 30 by reciprocally movement.

Figure 5:
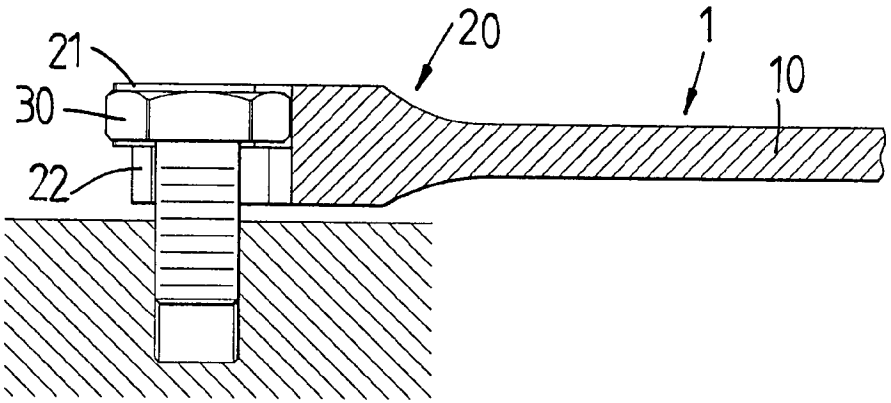
FIG. 5 is a side cross sectional view to show a bolt head is clamped by the other one of the function ends of the dual function wrench of the present invention.
Figure 4:
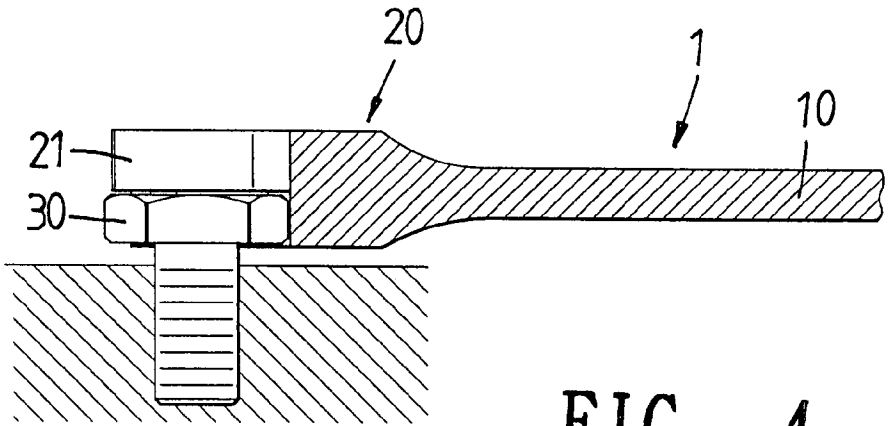
FIG. 4 is a side cross sectional view to show a bolt head is clamped by one of the function ends of the dual function wrench of the present invention.

As shown in FIGS. 4 and 5, because the clamping space between the two fixed jaws 21 of the first function end is made close to the size of the bolt head or nut 30, so that the user may use the first function end to hold the bolt head 30 firmly to quickly rotate the bolt head 30 into an object. If there is no enough room for the rotation of the wrench 1, the user can use the second function end to rotate the bolt head 30 with a small angular room.

While we have shown and described the embodiment in accordance with the present invention, it should be clear to those skilled in the art that further embodiments may be made without departing from the scope of the present invention.

What is claimed is:

1. A dual function wrench comprising:

a driving head and a shank connected to the driving head, the driving head including a first function end and a second function end, the first function end including two fixed jaws which have two respective flat clamping surfaces facing with each other, a first clamping space defined between the two fixed jaws of the first function end, the second function end including a first jaw and a second jaw, a second clamping space defined between the first and second jaws, the first and second clamping spaces being the same size, the two fixed jaws of the first function end being overlapped on the first and second jaws of the second function end, the first jaw having a first convex surface facing the second jaw, the second jaw having a second convex surface facing the first convex surface, a protrusion extending from a distal end of an inside of the second jaw and toward the first jaw, the protrusion including a concaved clamping area which is connected to an end of the second convex surface.

* * * * *